US010981042B2

(12) United States Patent
Parker

(10) Patent No.: US 10,981,042 B2
(45) Date of Patent: Apr. 20, 2021

(54) RETRACTABLE CORD SYSTEM

(71) Applicant: Eric Parker, Chula Vista, CA (US)

(72) Inventor: Eric Parker, Chula Vista, CA (US)

( * ) Notice: Subject to any disclaimer, the term of this patent is extended or adjusted under 35 U.S.C. 154(b) by 0 days.

(21) Appl. No.: 16/558,487

(22) Filed: Sep. 3, 2019

(65) Prior Publication Data

US 2020/0016467 A1 Jan. 16, 2020

Related U.S. Application Data

(63) Continuation-in-part of application No. 15/864,361, filed on Jan. 8, 2018, now Pat. No. 10,434,363.

(60) Provisional application No. 62/444,304, filed on Jan. 9, 2017, provisional application No. 62/613,311, filed on Jan. 3, 2018.

(51) Int. Cl.
*A63B 69/00* (2006.01)

(52) U.S. Cl.
CPC ..... *A63B 69/002* (2013.01); *A63B 2210/50* (2013.01); *A63B 2243/007* (2013.01)

(58) Field of Classification Search
CPC ..... A63B 22/0017; A63B 69/002; A63B 69/0028; A63B 63/007; A63B 2243/007; A63B 2071/026; A63B 2069/0037; B65H 75/4494
See application file for complete search history.

(56) References Cited

U.S. PATENT DOCUMENTS

| | | | | |
|---|---|---|---|---|
| 2,632,609 | A * | 3/1953 | Kirby | A01K 89/0171 242/375.1 |
| 2006/0125186 | A1* | 6/2006 | Digges, III | A63B 67/06 273/402 |
| 2006/0247072 | A1* | 11/2006 | Combs | A63B 67/007 473/348 |
| 2012/0196691 | A1* | 8/2012 | Maclean | A63B 57/357 473/172 |
| 2014/0227921 | A1* | 8/2014 | DeBruyn | B63C 11/49 441/79 |
| 2015/0108719 | A1* | 4/2015 | Devine | A63B 63/08 273/402 |

* cited by examiner

*Primary Examiner* — Jeffrey S Vanderveen

(57) ABSTRACT

This invention is directed toward a portable and easy to set up retractable cord system with means to allow athletes to move along specified routes and to form space indicators that show zone areas.

11 Claims, 14 Drawing Sheets

SECTION A-A

SECTION B-B

DETAIL C

SECTION A-A

SECTION B-B

DETAIL C

SECTION A-A

SECTION B-B

DETAIL C

FIG. 25A
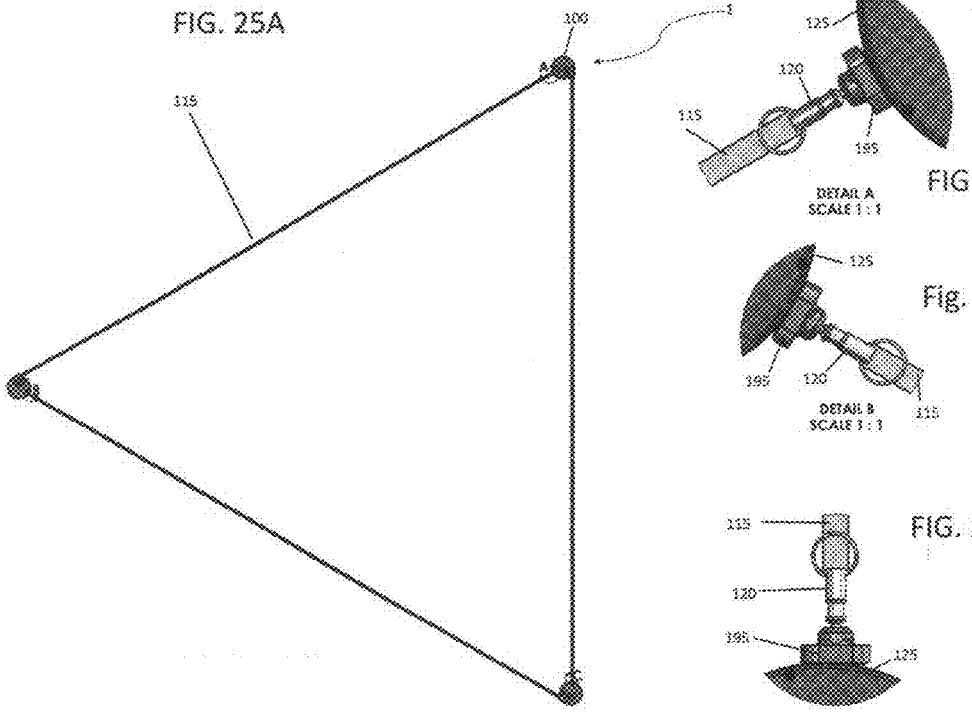
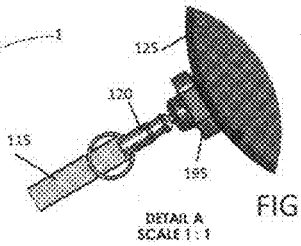
FIG. 25B
Fig. 25C
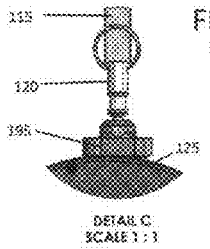
FIG. 25D

RETRACTABLE CORD SYSTEM

CROSS REFERENCE TO RELATED APPLICATIONS

Retractable cord cone system provisional (Application #62/444,304); Retractable cord system provisional (Application #62/613,311); Retractable cord system nonprovisional (application Ser. No. 15/864,361)

STATEMENT REGARDING FEDERALLY SPONSORED RESEARCH OR DEVELOPMENT

This invention was not federally sponsored.

BACKGROUND OF THE INVENTION

Field of the invention: This invention relates to the general field of athletic practice equipment, and more specifically, to a system that is capable of allowing athletes to visually see their offensive and defensive routes. The portable system allows coaches to instruct athletes without relying solely on auditory instruction and playbooks. The invention also acts as a space indicator, providing athletes with zone areas to move through.

Tactical understanding is often a misunderstood aspect of team sports. For inexperienced players especially, it is often difficult to understand coaches' auditory instruction. Not fully understanding a coach's words, especially during game time situations, can be the difference between winning and losing. In the game of football, for instance, a defensive player who is unaware of his position does not understand the coach's vocal play call, and subsequently moves in the wrong direction during a play can give up significant yardage or even a touchdown. An offensive player who does not understand a coach's vocal play call and ultimately runs the wrong route risks not gaining as many yards as expected.

It is also difficult for inexperienced players to understand the contents of a playbook. Defensive and offensive football players who don't grasp their playbooks put themselves in precarious positions. All the preparation and practice up to game time go to waste when the players do not understand the playbook.

Recognizing the offensive and defensive strategies of an opposing team can be difficult for youth players. Because sports like football move so quickly, it is important to know the other team's schemes thoroughly to improve the chances of winning the game. Inexperienced players, in addition to having difficulty knowing their own team's plays, often struggle to identify in real time the opposing team's plays, which can lead to easy scores and missed assignments.

Not only are the outcomes of plays influenced by players' knowledge, but players' health also hangs in the balance. An offensive or defensive player who is unable to understand a coach's vocal play call is also more likely to injure himself, since he often finds himself out of position in relation to the other players.

It is safe to say that auditory instruction and the conferment of a playbook to a player are not enough to teach mastery of the plays, both the player's plays and those of the opponent. There is too much risk for poor performance and/or injury. It is imperative to develop a system that helps players see where they are supposed to be.

The retractable cord system provides just such a solution by making it evident on the field where a player is supposed to be by having markers on the field, improving a player's tactical awareness and technical proficiency. The markers are easily visible and movable, allowing a player to visually see and move along different routes. The markers are low profile in nature; players do not risk tripping on them. In addition, the retractable cord system acts as a gridding system or space indicator, making players visually aware of the various zones on the playing field. For instance, in American football, in addition to the end zone, there are other zones that players must know in order to optimally perform, such as the swing, delay, flat, out, curl, hook, deep ⅓, deep ½, deep ¼, and shallow. The retractable cord system can be used to identify these zones on the playing field. In other words, the retractable cord system can create an on field or court diagram of offensive and defensive plays and concepts. Players being able to recognize these zones improves player safety, improves communication between coach and player, and ultimately leads to better player performance. While the retractable cord system works well for American football, it can be used for any sport or activity that requires space indicators, and moving within boundaries and along paths.

The retractable cord system is a perfect complement to auditory instruction and playbooks, since it further crystallizes where the player is supposed to be on the field. The retractable cord system essentially takes the contents of a playbook, once limited to paper or whiteboards, and places them on the playing field, making it easier for inexperienced players to learn the plays they need to know to be successful in the sport.

There is prior art that describes placing pieces on a regulation field to assist in setting up offensive and defensive sets. The prior art is merely for player placement, though, not player movement. Prior art exists that trains players on how to step correctly, but this prior art only covers the first step, not the entire running of a route.

SUMMARY OF THE INVENTION

It is therefore an object of the retractable cord system to provide a system by which an offensive or defensive player, or any athlete, can visually see either his routes to run or his defensive coverages, and to act as a space indicator so that an athlete can identify zone areas to move in.

An embodiment of the retractable cord system comprises a reel that both unravels and coils a cord. The reel is comprised of a roll, inner brackets, outer brackets, links, crank, and crank handle. The roll is supported between two inner brackets, and the inner brackets are between two outer brackets. The links connect the outer brackets to each other. The crank is attached to one end of the roll. The crank handle is connected to the crank. The cord is coiled around the roll. Turning the crank handle of the reel in one direction unravels the cord, while turning the crank handle in the opposite direction reels the cord back in to its coiled state. A fixed weight is connected to the distal end of the cord and a sliding weight assembly (weights connected together by a weight strap) is free to slide up and down the cord, allowing the cord to be positioned at various angles. The method by which this embodiment operates is as follows: the user turns the crank handle in a rotating fashion, allowing the cord to unravel, the user slides the sliding weight assembly to the desired location along the cord, the user picks up the fixed weight and moves it to the desired location to create an angle within the cord, and the user turns the crank handle in the opposite rotating direction to reel the cord back in. This embodiment may also be without the reel, comprising a cord with a fixed weight at both ends of the cord and a sliding weight assembly able to slide up and down the cord, allowing the cord to be set at various angles. The method of use is as follows: the user moves the sliding weight assembly to the desired location, the user picks up the fixed weight at one end of the cord and moves it to the desired location, and the user picks up the fixed weight at the other end of the cord and moves it to the desired location, creating an angle in the cord.

In another embodiment, the retractable cord system is comprised of a portable containment cone that houses at least one retractable unit whose spool of cord is pulled from the retractable unit and exits through a slot in the base of the side surface of the containment cone. The containment cone has a handle on its top surface for easy transport. The retractable unit is comprised of a shell that houses a spool of cord that is retractable. A crossbar that spans from one side of the interior side surface of the containment cone to the other side supports the retractable unit. The cord exits the containment cone through a slot at the base of the containment cone. There can be one or a plurality of slots located along the base of the side surfaces of the containment cone. By lifting up the containment cone, it is possible to move the cord from slot to slot. The retractable unit is rotatable 360 degrees to accommodate the movement of the cord from slot to slot. If there is only one slot, there is no need to move the cord from slot from slot. A plurality of slots, however, allows the cord to be directed to different sides of the containment cone, and, ultimately, different locations on the field. A fixed weight attached the cord keeps the cord in place while a sliding weight attached to the cord allows angles to be made in the cord at different locations along the cord. In one instance, at one end of the spool of cord is the fixed weight, meant to keep the cord in place when pulled out. The sliding weight is attached between the fixed weight and the shell. The sliding weight can slide up and down the cord, creating different angles that are dependent on the sliding weight's location along the cord. The cord can have at least one cord clip attached to the cord, and the cord clip can have a supplementary cord connected to the cord clip so that the supplementary cord can be placed at different angles. The cord clip comprises an upper lip and a cord clip ring. The cord clip ring goes through the cord and the upper lip presses down on an end of the supplementary cord. The supplementary cord has a fixed weight at its distal end to keep the cord in place. A player, either offensive or defensive, can move along the length of the cord or supplementary cord to simulate game conditions. On its top surface, the containment cone has openings that can accommodate video attachments. The video attachments can accommodate devices with video capabilities like video cameras, digital cameras, mobile devices, tablets, and GoPro cameras. After the running of the play, the player can watch his movements on the device with video capabilities. In essence, the benefits of this embodiment include a) an easy-to-see marker, being the containment cone, that players can identify, even from a distance, b) easy-to-see cord and weights that athletes can follow to better learn the plays they are supposed to know, c) a portable containment cone that can be set up with ease, d) video attachments attached to the containment cone that can accommodate devices with video capabilities, allowing athletes to look back on their performance after the call has ended, e) openings on the top surface of the containment cone that can accommodate video attachments. The method of using this embodiment are as follows: the user moves the cone to the desired location, the user pulls out the cord through a slot in the cone, the user slides the sliding weight to the desired location and places the fixed weight at the desired location to create an angle in the cord, the user attaches a cord clip to the cord and connects a supplementary cord to the cord clip (if desired), the user places the supplementary cord at the desired location to create an angle between the cord and the supplementary cord, the user attaches video devices to the video attachments in the cone, the user removes the supplementary cord from the cord clip and removes the cord clip from the cord, and the user retracts the cord back into the cone.

In another embodiment, the retractable cord system comprises a plurality of discs, each disc housing a strap. The strap exists as a spool within a disc. The strap from each disc exits the disc and connects to an adjacent disc via circumference of the discs. The strap has the ability to expand and collapse, based on the push of a button. The button is on one of the flat surfaces of the disc. When the button is pushed from its original position, a compression spring presses down, locking in the strap in the expanded position. When the button is pushed again, the compression spring releases, which engages a tension spring that allows the strap to return to its collapsed state. When the discs are pulled apart, the strap expands, allowing the discs to be positioned in specific shapes. For instance, if there are three discs, the shape would be a triangle. If there are four discs, the shape would be a quadrilateral. Other polygons besides triangles and quadrilaterals are possible depending on the number of discs the retractable cord system has. The strap has distance markers on its surface that indicate the length of the uncoiled strap. For instance, a "1" could indicate 1 meter, 1 yard, 1 foot, or another unit of length. The method of operating this embodiment is as follows: a user pulls the plurality of discs to the expanded state, a user presses the button to lock in the expanded state of the strap, a user presses the button again to release the strap, allowing the strap to return to the collapsed state.

In yet another embodiment, the retractable cord system comprises a disc that is connected to an expandable strap. The strap exists as a spool within the disc that extends out of the disc. The disc has at least 1 ring around the disc's circumference. A snap hook attaches to the distal end of the strap. The snap hook that is attached to the strap of one disc can attach to the ring of an adjacent disc, connecting several discs together. By connecting several discs together, a user can create angles between several straps. The strap has the ability to expand and collapse, based on the push of a button. The button is on one of the flat surfaces of the disc. When the button is pushed from its original position, a compression spring presses down, locking in the strap in the expanded position. When the button is pushed again, the compression spring releases, which engages a tension spring that allows the strap to return to its collapsed state. The method of using this embodiment is: a user pulls the strap from a disc and presses the button to lock the strap's position, the user connects the snap hook that is connected to the distal end of the strap to the ring of an adjacent disc, the user pulls the strap from the other disc and presses the button to lock the strap's position and create an angle between both straps, the user follows the preceding two steps to connect more discs, the user presses the buttons of the discs to release the straps back to their collapsed states.

In yet another embodiment, the retractable cord system has a receptacle, comprising a top portion and bottom portion that are flush. Connecting the top portion and bottom portion is by any means known in the art, such as screws, adhesives, welding, and soldering. A spool of strap is within the bottom portion, with the strap exiting the bottom portion via an opening. A button is on the outward facing surface of the top portion; the button is connected to a ladder and spring on the inner surface of the top portion. A ring encircles the bottom portion, but can also encircle the top portion. A keyring is at the free end of the strap, with the keyring able to attach to the ring of other retractable cord systems. The means by which the keyring attaches to the ring can be any known in the art. A ring that is magnetic can attract a keyring that attaches to magnetic materials, so a metal ring and a magnet connected to the keyring are appropriate. Other materials for the ring and keyring are also allowable, such as polymer, ceramics, and composites. For instance, a felt ring can attach keyrings with Velcro ends. Spikes exist on the bottom surface of the bottom portion with the purpose of grounding the retractable cord system into a playing surface. The depth of the spikes is important, as spikes that are too shallow will not adequately ground or anchor the retractable cord system into the playing surface, and spikes too deep will destroy the playing surface. For this reason, spike depth between 6 mm (¼ inch) and 18 mm (¾ inch) inclusive is suitable. The spikes can be at a 90 degree angle with a playing or a non-90 degree angle with the playing. Different patterns of the spikes are also possible. For instance, for one pattern, the spikes are 90 degrees, but in a different location of the bottom portion, the spikes are at non-90 degree angles. The type of spikes are also interchangeable; pin, needle, blank, pyramid, Spartan, and Christmas tree spikes are all possible. While the spikes can be formed directly on the bottom portion, a separate piece can be attached to the bottom portion by means known in the art, like screwing, welding, adhesives, and soldering. If a separate piece for the spikes is used, this piece is attachable as needed. For instance, a piece with needle spikes can be swapped out for a piece with pyramid spikes. For the strap to be in an expanded state, it must be pulled out from the receptacle to the desired length. The strap exists as a spool inside the bottom portion with the spool encircling a retractor. The spool rotates around the retractor when being pulled out and being returned to inside the receptacle. To return the strap to a collapsed state within the bottom portion, the button is deployed, which triggers the ladder to compress the spring, and the strap returns through the opening into the receptacle. The deployment of the button can be by any physical means, such as pushing, pulling, pressing, and any other physical or even mechano/electronic means known in the art. In addition to the keyring being attached to the distal end of the strap, discs of varying sizes are also attachable to the strap. The discs have spikes on their bottom surfaces to allow for grounding (i.e. anchoring) to the playing surface.

Regardless of the embodiment, the strap is made of a flexible and durable material, such as a soft plastic such as polyethylene, polyamide, and polypropylene. The material of the receptacle should be durable, wear and weather-resistant, and light-weight so that the retractable cord system is easily portable. Hard plastics such as thermoplastics, thermosets, polyvinyl chloride, polyepoxide, acrylonitrile butadiene styrene, polytetrafluoroethylene, and polystyrene are ideal for the receptacle material, but lightweight metals are also appropriate. The strap, when in the expanded state, can start at a minimum distance of 0 to reach the maximum distance of any desired playing field length. For instance, in the game of American football, a minimum distance of 10 yards per disc would be most effective for teaching purposes. The retractable cord system must be free of sharp edges for safety reasons.

There has thus been outlined, rather broadly, the more important features of the retractable cord system in order that the detailed description thereof may be better understood, and in order that the present contribution to the art may be better appreciated. There are additional features of the retractable cord system that will be described hereinafter and which will form the subject matter of the claims appended hereto. The features listed herein and other features, aspects, and advantages of the retractable cord system will become better understood with reference to the following description and appended claims.

BRIEF DESCRIPTION OF THE FIGURES

The accompanying drawings, which are incorporated in and form a part of this specification, illustrate embodiments of the retractable cord system and together with the description, serve to explain the principles of the retractable cord system.

FIG. 25A is a top view of multiple retractable cord systems of the embodiment of FIGS. 23A and 23B connected together, with FIGS. 25B, 25C, and 25D being magnified top views of each retractable cord system.

DETAILED DESCRIPTION OF THE FIGURES

Figure 1:
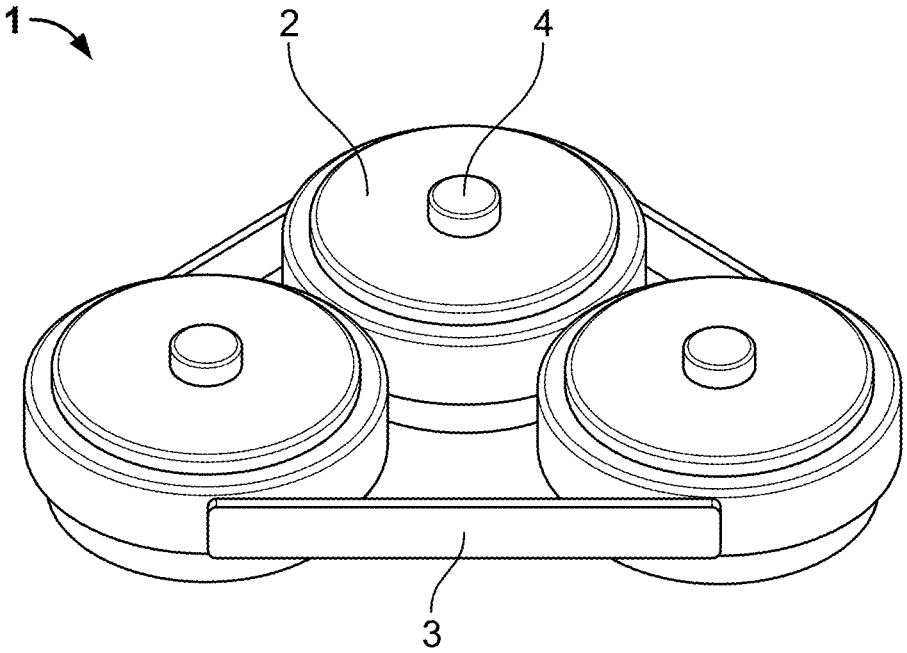
FIG. 1 is a representative collapsed perspective view of an embodiment of the retractable cord system, with discs connected via a strap.
Figure 2:
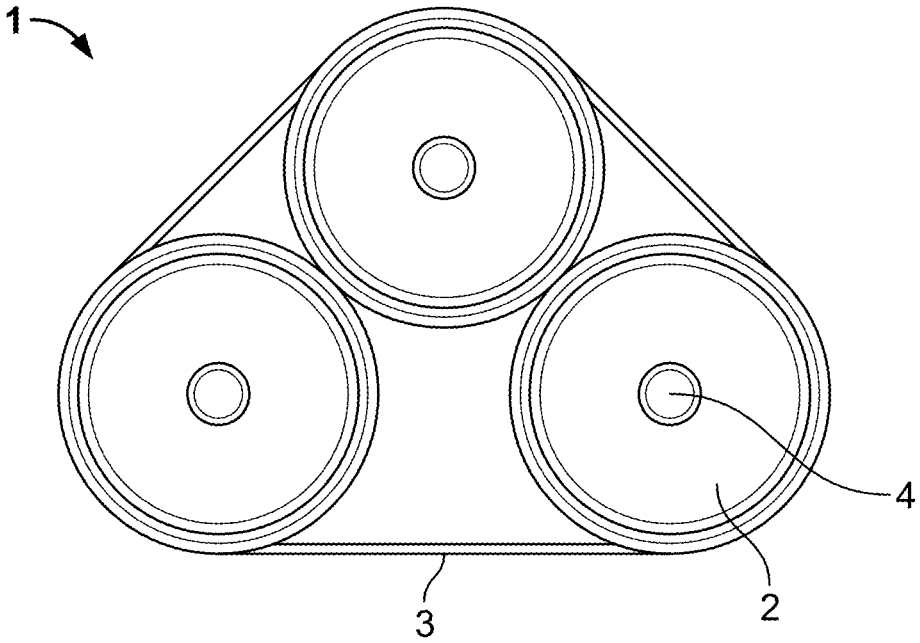
FIG. 2 is a collapsed top view of the embodiment shown in FIG. 1.
Figure 3:
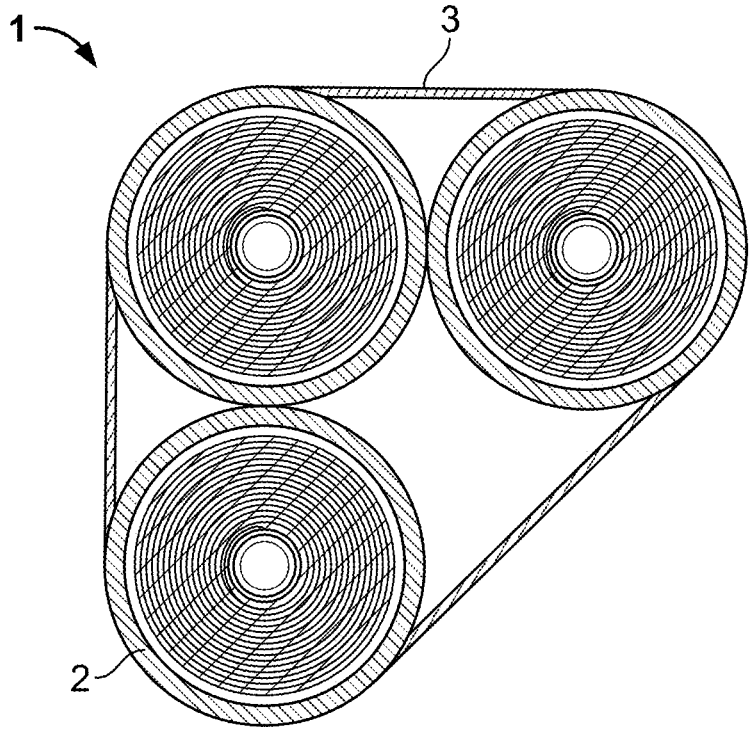
FIG. 3 is a collapsed cross-sectional top view of the embodiment shown in FIG. 1.
Figure 4:
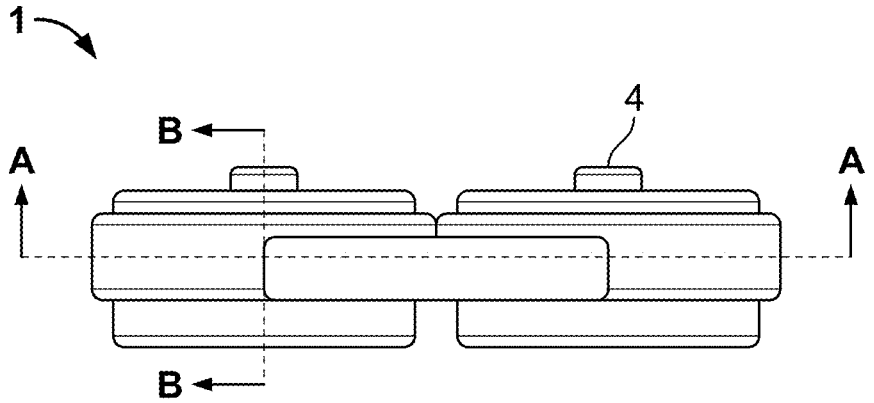
FIG. 4 is a collapsed side view of the embodiment shown in FIG. 1, showing the button that a user pushes to lock and release the strap.

Many aspects of the retractable cord system can be better understood with references made to the drawings below. The components in the drawings are not necessarily drawn to scale. Instead, emphasis is placed upon clearly illustrating the components. Before explaining at least one embodiment, it is to be understood that the embodiments of the retractable cord system are not limited in their application to the details of construction and to the arrangement of the components set forth in the following description or illustrated in the drawings. The embodiments of the retractable cord system are capable of being practiced and carried out in various ways. In addition, the phraseology and terminology employed herein are for the purpose of description and should not be regarded as limiting.

FIGS. 1, 2 3, and 4 are the collapsed perspective view, collapsed top view, collapsed cross-sectional top view, and a collapsed side view, respectively, of an embodiment of the retractable cord system 1, with discs 2 connected via a strap 3. The strap 3 originates within the housing of the disc 2 as a spool. Adjacent discs 2 are connected to each other by a strap 3 exiting one disc 2 and entering into an adjacent disc 2. Essentially, upon exiting one disc 2, the strap 3 attaches to an adjacent disc 2 along the circumference of the disc 2. A button 4 is on one of the flat surfaces of the disc 2.

Figure 5:
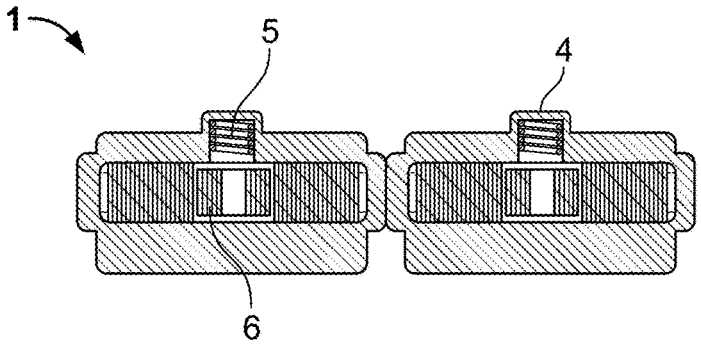
FIG. 5 is an alternative collapsed cross-sectional side view of the embodiment shown in FIG. 1, showing the compression spring and tension spring that are responsible for extending and collapsing the strap.

FIG. 5 is an alternative collapsed cross-sectional side view of the embodiment shown in FIG. 1, showing the compression spring 5 and tension spring 6 that are responsible for extending and collapsing the strap 3. Pressing the button 4 from its original position engages the compression spring 5, which locks the strap 3 when in the expanded state. The compression spring 5 lies within the button 4. Pressing the button 4 again releases the compression spring 5, placing tension on the tension spring 6, which allows the strap 3 to collapse.

Figure 6:
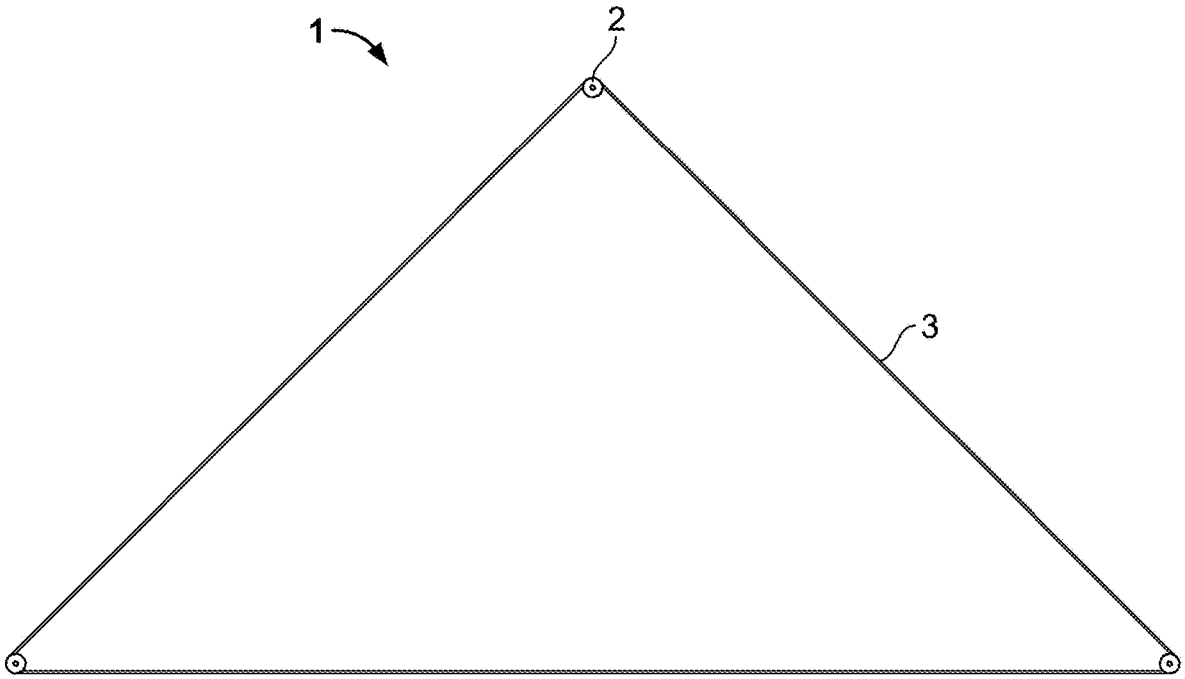
FIG. 6 is an expanded top view of the embodiment shown in FIG. 1.

FIG. 6 is an expanded top view of the embodiment shown in FIG. 1. The strap 3 is in the expanded state. When in the expanded state, this embodiment of the retractable cord system 1 assumes the shape of a triangle. The shape of the retractable cord system 1 will differ based on the number of discs 2.

Figure 7:
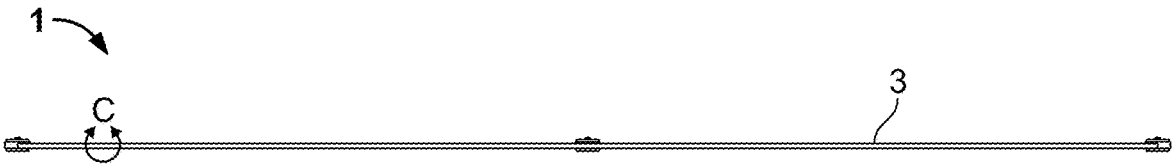
FIG. 7 is an expanded side view of the embodiment shown in FIG. 1.
Figure 8:
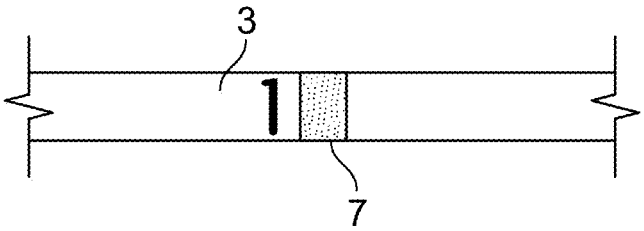
FIG. 8 is an enlarged view of a part of the strap shown in FIG. 7, denoting the distance marker on the strap.

FIG. 7 is an expanded side view of the embodiment shown in FIG. 1, with FIG. 8 as an enlarged view of the strap 3 from FIG. 7. On the strap 3, there are distance markers 7 that show each length the strap 3 is expanded. For instance, the number "1" may indicate that the strap is expanded 1 unit of length. The unit of length may be any common unit, such as yards, feet, meters, or another unit of length.

FIGS. 9, 10, 11, and 12 are the collapsed perspective view, collapsed top view, collapsed cross-section top view, and collapsed side view, respectively, of another embodiment of the retractable cord system 1, with discs 2 connected via a strap 3. In this instance, there are four discs 2. The strap 3 originates within the housing of the disc 2 as a spool. Adjacent discs 2 are connected to each other by a strap 3 exiting one disc 2 and entering into an adjacent disc 2. Essentially, upon exiting one disc 2, the strap 3 attaches to an adjacent disc 2 along the circumference of the disc 2. A button 4 is on one of the flat surfaces of the disc 2.

Figure 9:
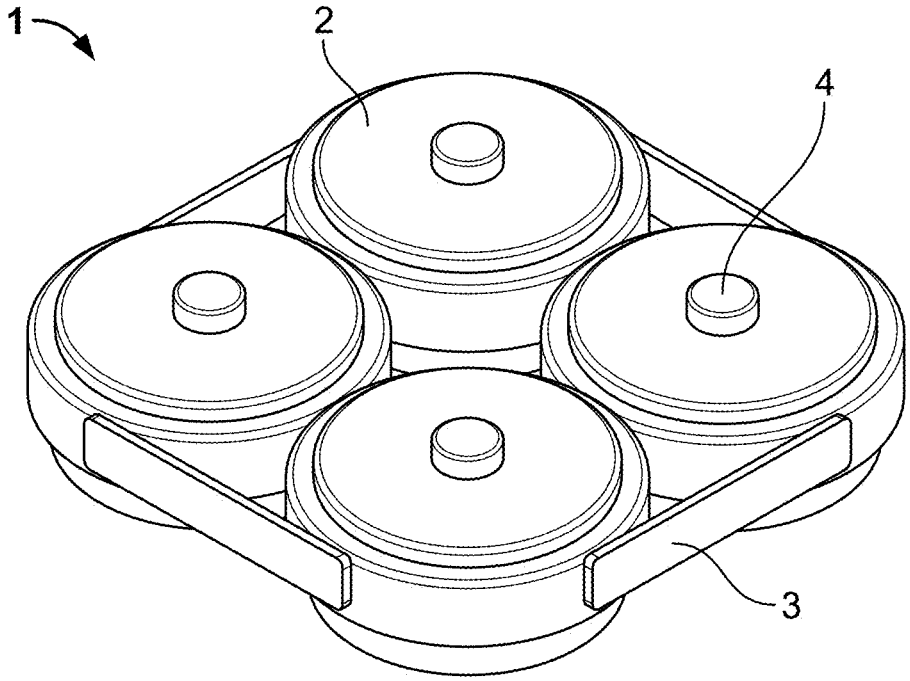
FIG. 9 is a perspective collapsed view of another embodiment of the retractable cord system, showing the discs connected via a strap.
Figure 10:
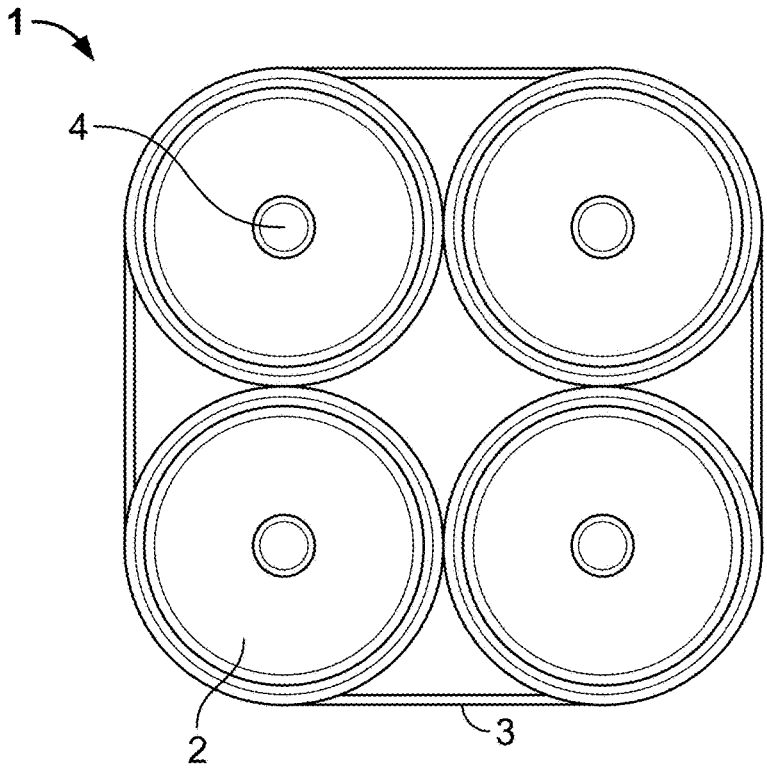
FIG. 10 is a collapsed top view of the embodiment shown in FIG. 9.
Figure 11:
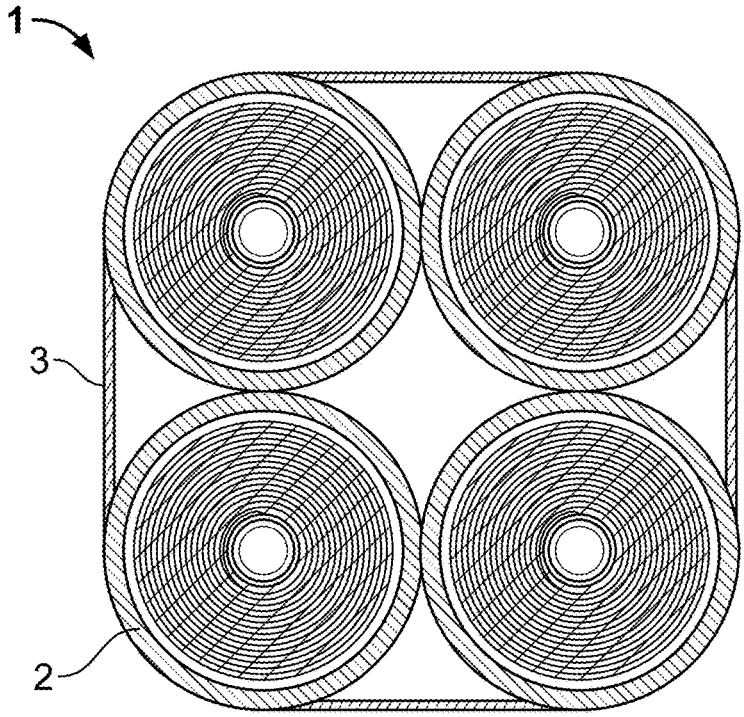
FIG. 11 is a collapsed cross-sectional top view of the embodiment shown in FIG. 9.
Figure 12:
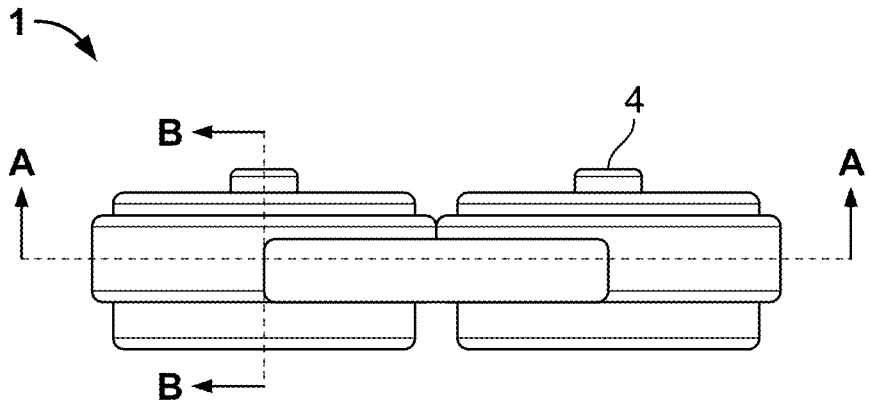
FIG. 12 is a collapsed side view of the embodiment shown in FIG. 9, showing the button that locks and releases the strap.
Figure 13:
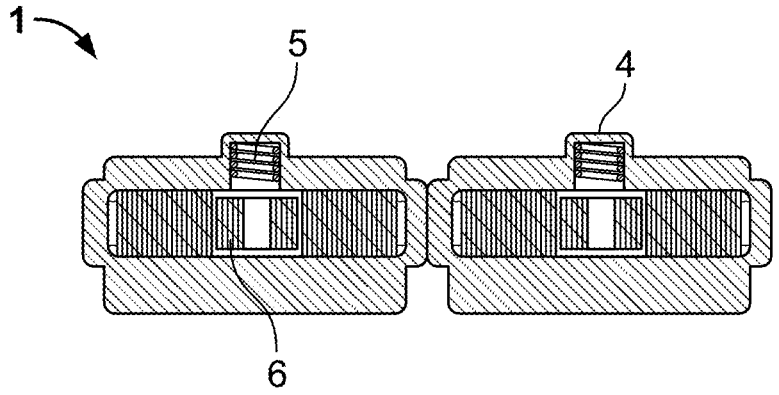
FIG. 13 is an alternative cross-sectional side view of the embodiment shown in FIG. 9, denoting the compression spring and tension spring used for expanding and collapsing the strap.

FIG. 13 is an alternative collapsed side view of the embodiment shown in FIG. 9, showing the compression spring 5 and tension spring 6 that are responsible for extending and collapsing the strap 3. Pressing the button 4 from its original position engages the compression spring 5, which locks the strap 3 when in the expanded state. Pressing the button 4 again releases the compression spring 5, placing tension on the tension spring 6, which allows the strap 3 to collapse to the collapsed state. The compression spring 5 lies within the button 4.

Figure 14:
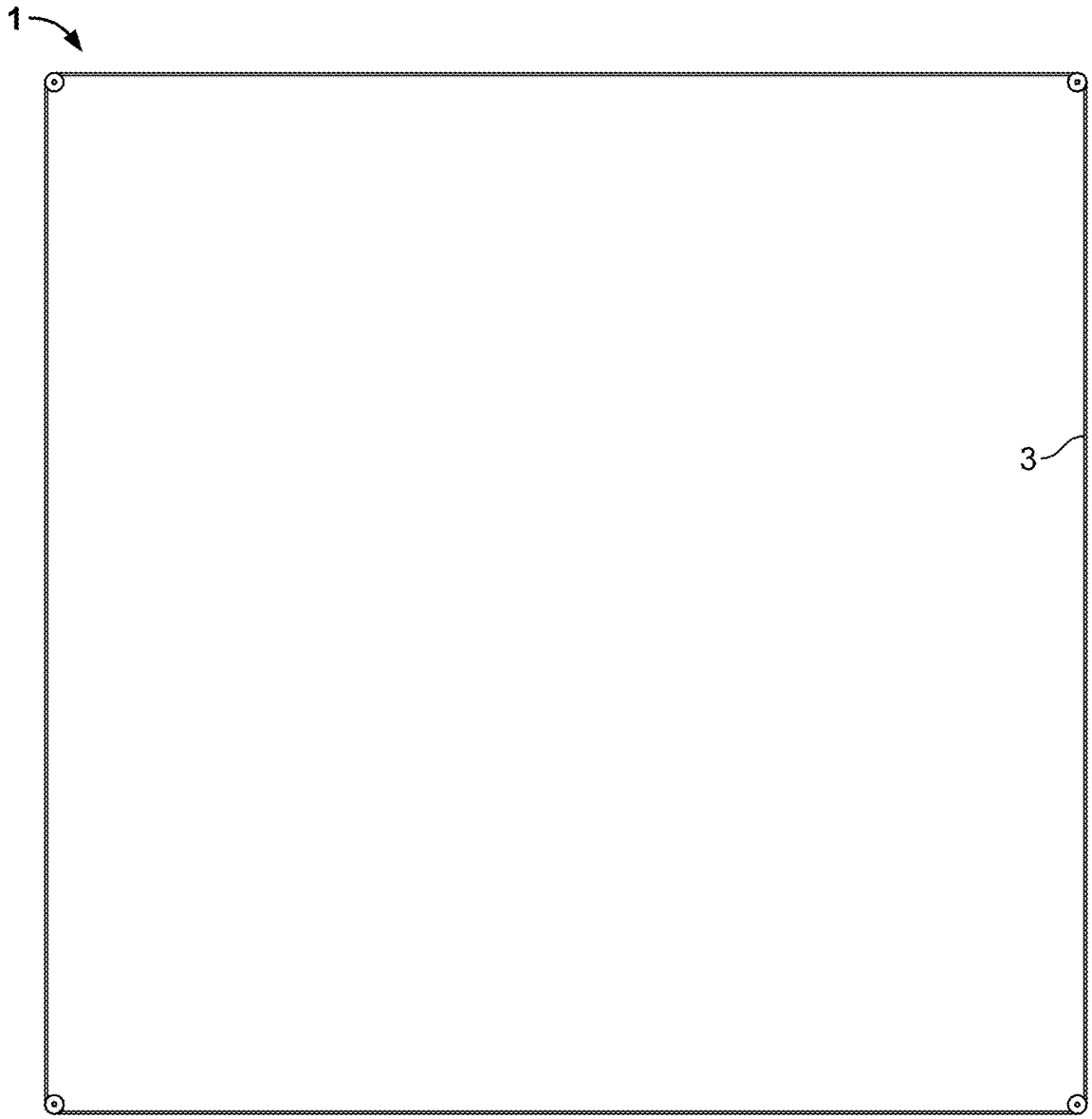
FIG. 14 is an expanded top view of the embodiment shown in FIG. 9.

FIG. 14 is an expanded top view of the embodiment of the retractable cord system 1 shown in FIG. 9. The strap 3 is in the expanded state. When in the expanded state, this embodiment of the retractable cord system 1 assumes the shape of a quadrilateral.

Figure 15:
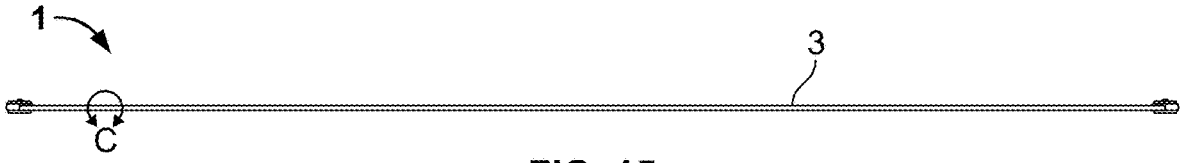
FIG. 15 is an expanded side view of the embodiment shown in FIG. 9.
Figure 16:
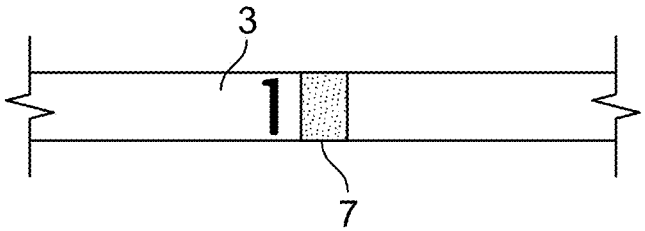
FIG. 16 is an enlarged view of a part of the strap shown in FIG. 15, denoting the distance marker on the strap.

FIG. 15 is an expanded side view of the embodiment shown in FIG. 9, with FIG. 16 as an enlarged view of the strap 3 from FIG. 15. On the strap 3, there are distance markers 7 that show each length the strap 3 is expanded. For instance, the number "1" may indicate that the strap is expanded 1 unit of length, such as yards, feet, meters, or another unit of length.

Figure 17:
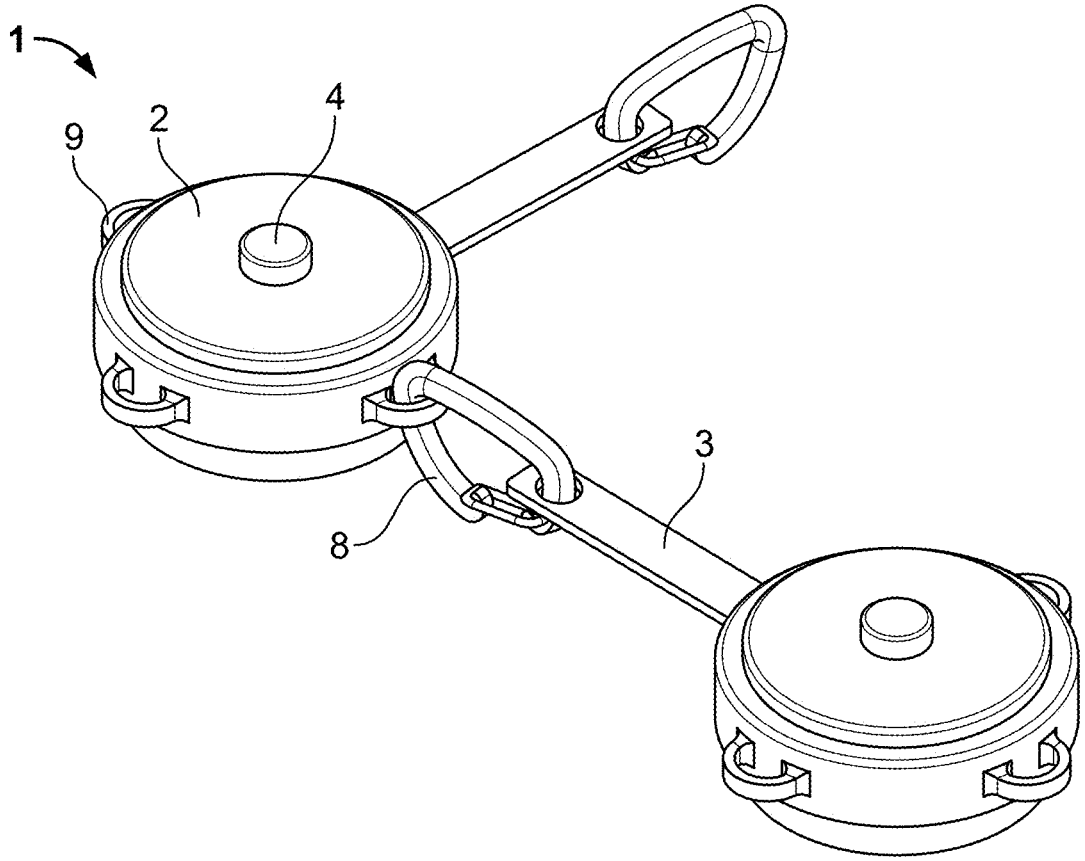
FIG. 17 is the collapsed perspective view of another embodiment of the retractable cord system, showing two discs connected by a strap-snap hook configuration.
Figure 18:
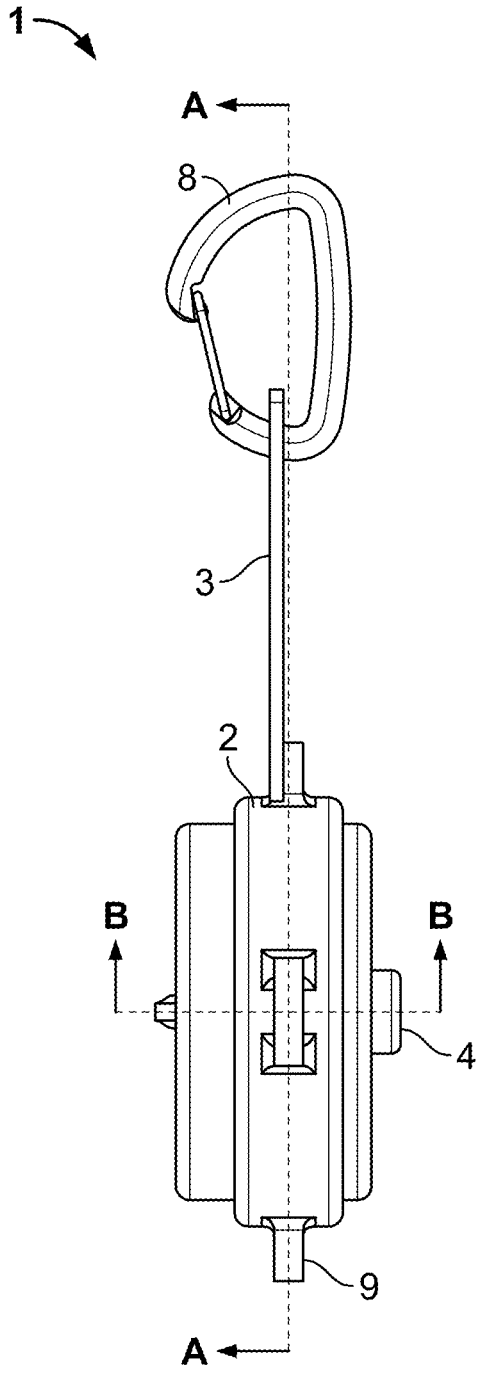
FIG. 18 is the collapsed side view of the embodiment shown in FIG. 17, showing the button used to lock and release the strap.
Figure 19:
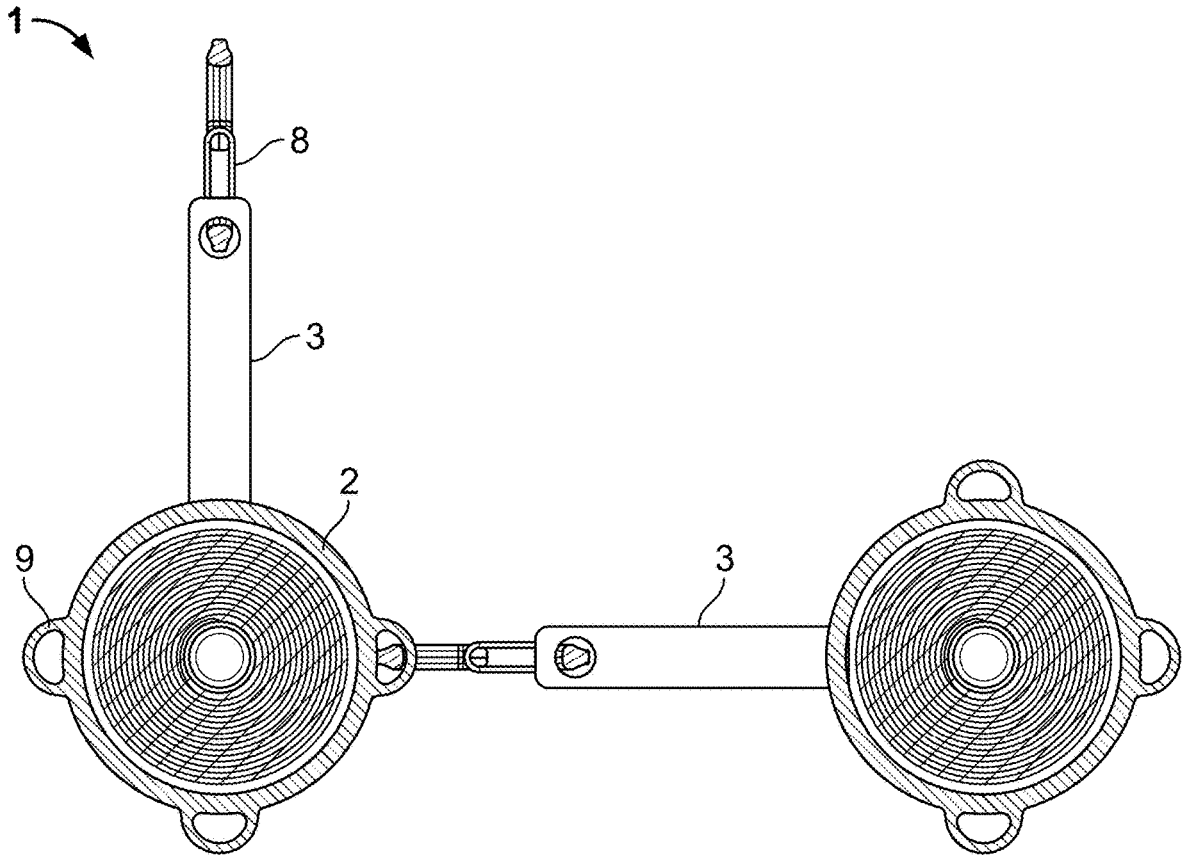
FIG. 19 is the collapsed cross-sectional top view of the embodiment shown in FIG. 17.

FIGS. 17, 18, and 19 are the collapsed perspective view, collapsed side view, and collapsed cross-sectional top view, respectively, of another embodiment of the retractable cord system 1, showing discs 2 connected by a strap 3 and snap hook 8 configuration. The strap 3, which exits the disc 2, originates as a spool within the disc 2. The snap hook 8 attaches to the distal end of the strap 3. The snap hook 8 attaches to the disc 2 by way of a ring 9 that lines the circumference of the disc 2. A button 8 exists on one of the flat surfaces of the disc 2. Several discs 2 can be connected together by the strap 3 emanating from one disc 2 connecting to a snap hook 8, which then connects to the ring 9 of an adjacent disc 2.

Figure 20:
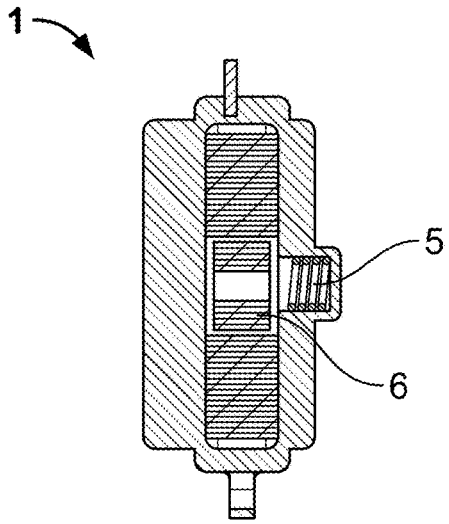
FIG. 20 is a collapsed cross-sectional side view of the embodiment shown in FIG. 17, denoting the compression spring and tension spring responsible for expanding and collapsing the strap.

FIG. 20 is an alternative collapsed cross-sectional side view of the embodiment shown in FIG. 17, showing the compression and tension springs that are responsible for extending and collapsing the strap. Pressing the button 4 from its original position engages the compression spring 5, which locks the strap 3 when in the expanded state. Pressing the button 4 again releases the compression spring 5, placing tension on the tension spring 6, which allows the strap 3 to collapse to the collapsed state. The compression spring 5 lies within the button 4.

Figure 21:
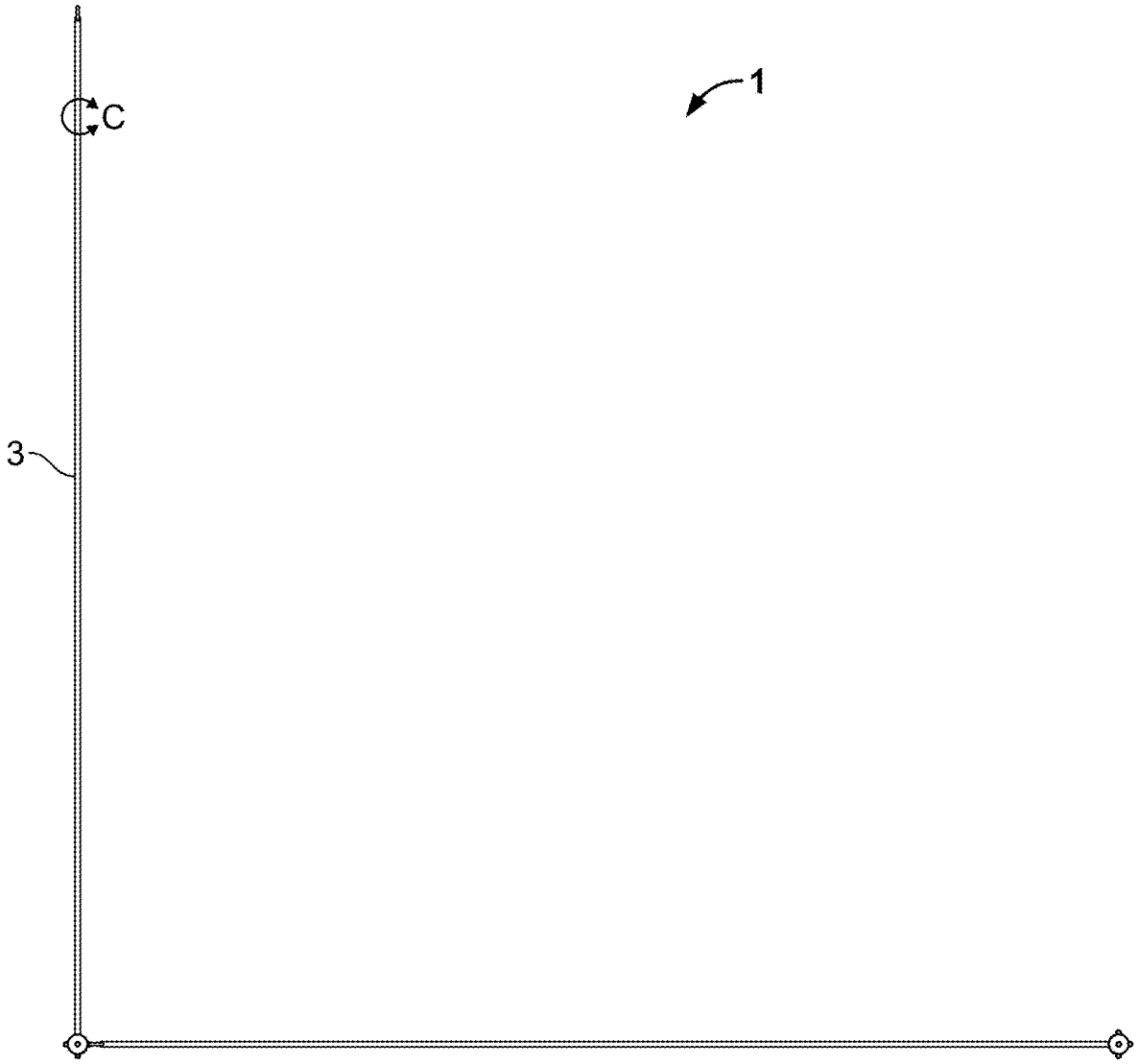
FIG. 21 is an expanded top view of the embodiment shown in FIG. 17.
Figure 22:
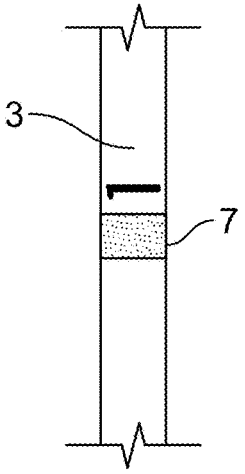
FIG. 22 is an enlarged view of a part of the strap shown in FIG. 21, denoting the distance marker on the strap.

FIG. 21 is an expanded top view of the embodiment shown in FIG. 17, with FIG. 22 as an enlarged view of the strap 3 from FIG. 21. On the strap 3, there are distance markers 7 that show each length the strap 3 is expanded. For instance, the number "1" may indicate that the strap is expanded 1 unit of length, such as yards, feet, meters, or another unit of length.

Figures 23A, 23B:
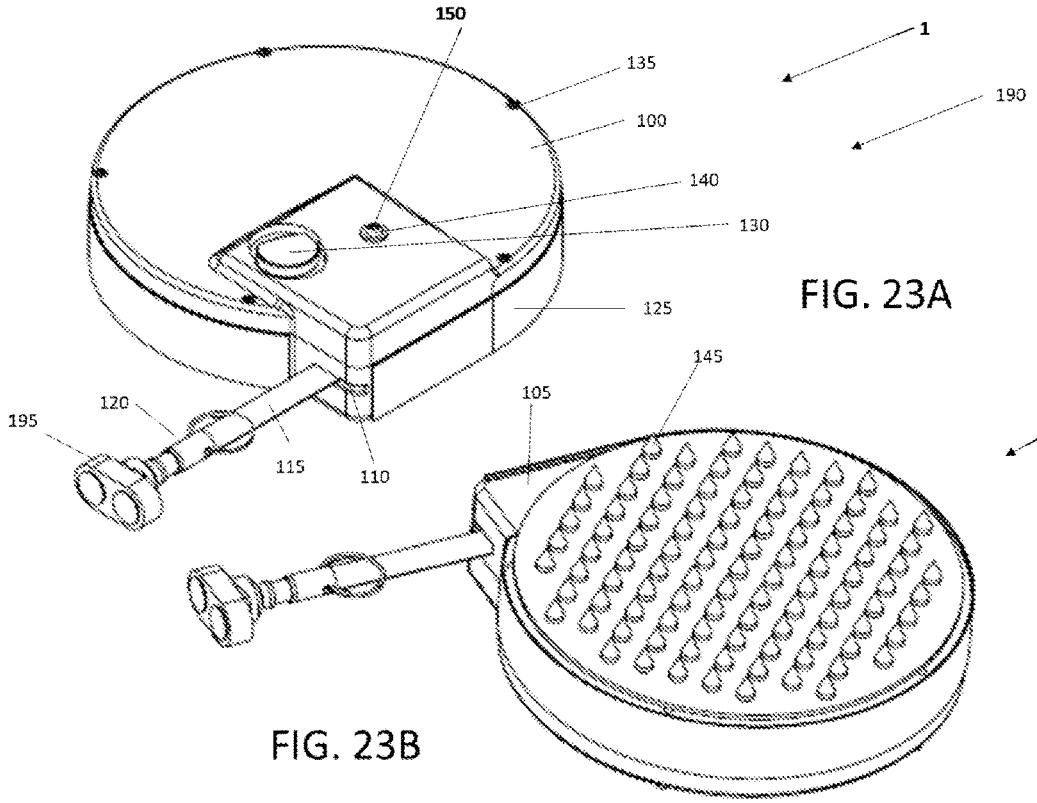
FIGS. 23A and 23*b* are perspective collapsed views of another alternative embodiment of the retractable cord system, with 23A being a top view and 23B being a bottom view.

FIG. 23*a* and FIG. 23*b* is perspective top and bottom view, respectively, of another alternative embodiment of the retractable cord system 1. The receptacle 190 is comprised of a top portion 100 and bottom portion 105. The top portion 100 and bottom portion 105 are flush, connected by screws 135, although the top portion 100 and bottom 105 can be connected via any means known in the art. The strap 115 exits from the opening 110, with the keyring 120 attached the free end of the strap 115. The ring 125 encircles the bottom portion 105. The ring 125 can be made up of any material that allows the keyring 120 to attach to it. If made of a magnetic material such as metal, the ring 125 will allow a keyring 120 with a magnet 195 at the end of the keyring 120 to attach. The keyring 120 will then be able to be moved along the surface of the ring 125. While metal is a suitable material for the ring, other materials, such as polymers, ceramics, and composites, can allow be used as the material for the ring 125. The ring 125 may attach to the bottom portion 105 via any conventional means, such as adhesive, welding, soldering, and screwing. The spikes 145 on the bottom portion 105 are for grounding into a playing surface. Grounding the retractable cord system 1 secures it, anchoring it in the playing surface. The spikes must be of sufficient depth to penetrate into the playing surface to ensure secure placement. These figures show the strap 115 in a collapsed state; the majority of the strap 115 is within the bottom portion 105.

Figure 24:
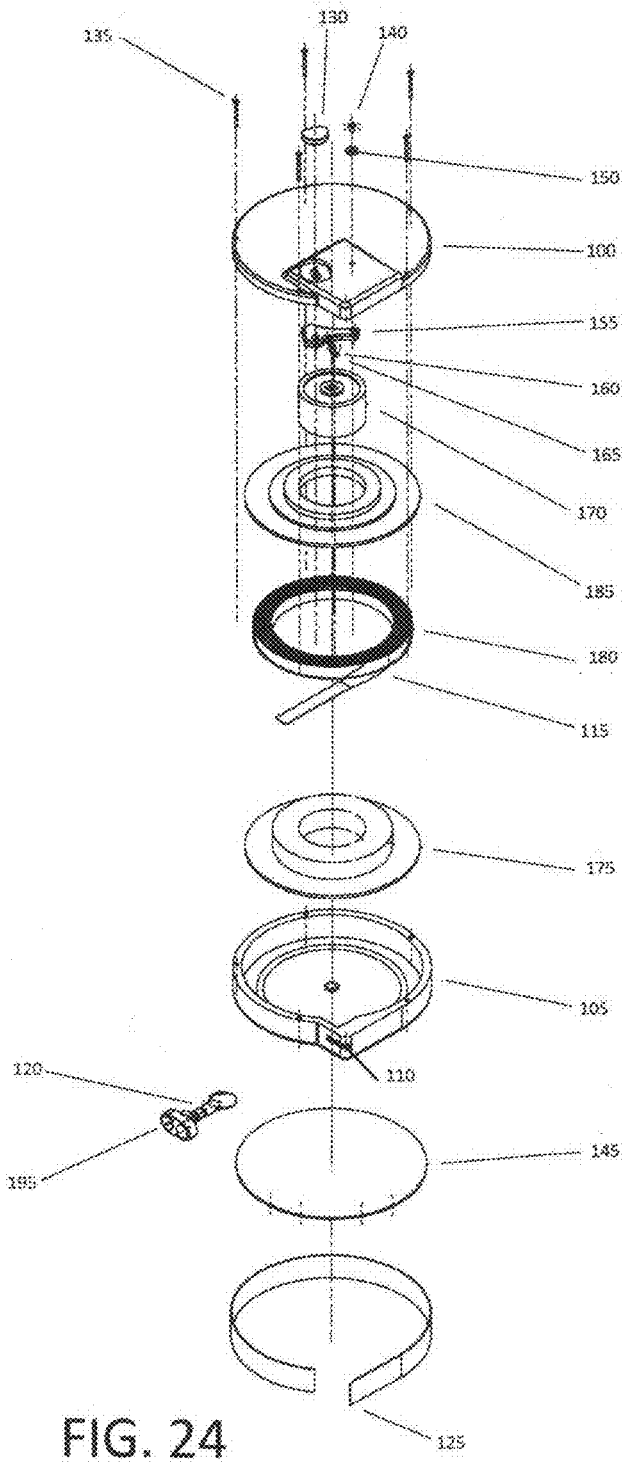
FIG. 24 is an exploded view of embodiment shown in FIGS. 23A and 23B.

FIG. 24 is an exploded view of the embodiment of the retractable cord system 1 of FIGS. 23*a* and 23*b*. The ladder 155 and spring 160 are on the inner surface of the top portion 100, while the button 130 is on the outward surface of the top portion 100. Screws 135 secure the top portion 100 to the bottom portion 105. A ladder screw 140 and washer 150 secure the ladder 155 to the inner surface of the top portion 100. A spring screw 165 secures the spring 160 to the inner surface of the top portion 100. The button 130, ladder 155, and spring 160 are interconnected; the ladder 155 is connected to the spring 160 and the button 130. The deployment of the button 130 causes the ladder 155 to compress the spring 160, which allows the strap 115 to return to a collapsed state within the bottom portion 105. While, in this embodiment, deployment is executed by pushing the button 130 laterally, deployment can be by any means, including pressing, pushing, pulling, or any other physical means. The strap 115 exists as a spool 180 inside the bottom portion 105, with the strap 115 exiting the bottom portion 105 via an opening 110. The spool 180 rests on a first disc 175, with a second disc 185 on top of the spool 180; the first disc 175 and second disc 185 are meant to keep the spool 180 in place within the bottom portion 105. The spool 180 surrounds a retractor 170, with the retractor 170 rotating when the strap 115 is removed from the bottom portion 105 and when the strap 115 is returned through the opening 110 into the bottom portion 105. Spikes 145 are on the bottom surface of the bottom portion 105. While the spikes can be manufactured directly onto the bottom surface of the bottom portion 105, the spikes 145 can, as seen in the figure, be manufactured separately and attached to the bottom portion 105 via conventional mans like adhesive, welding, soldering, and other means known in the art. The ring 125 encircles the bottom portion 105, with the keyring 120 moving along the surface of the ring 125. A magnet 195 at the distal end of the keyring 120 is how the keyring 120 is attachable to the ring 125.

FIG. 25*a* shows a view of multiple retractable cord systems 1 connected together, with FIGS. 25*b*, 25*c*, and 25*d* showing magnified views of the multiple retractable cord systems 1 connected together. In FIG. 25*a*, the strap 115 is shown in the expanded state, that is, when the strap 115 is pulled from the bottom portion 105. Three retractable cord systems 1 are shown in FIG. 25*a*, but configurations with more than three or less than three retractable cord systems 1 are also possible. Multiple retractable cord systems 1 connect to each other to form angles. FIG. 25*a* shows three retractable cord systems 1 connected together via their straps 115 to form a triangle. FIGS. 25*b*, 25*c* and 25*d* show the result of the keyring 120 from FIGS. 23*a* and 23*b* attaching to the rings 125 of other retractable cord systems 1. The keyring 120 is on the free end of the strap 115, with a magnet 195 at the distal end of the keyring 120. When the strap 115 is pulled out from the bottom portion 105, the keyring 120 from one retractable cord system 1 attaches to the ring 125 of another retractable cord system 1 via the magnet 195.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A retractable cord system for grounding on a playing surface, comprising a receptacle, a strap, a button, a spring, a plurality of spikes, a ring, at least one keyring, a ladder connected to the button and connected to the spring, and a retractor;

where the receptacle further comprises a top portion and a bottom portion with the top portion and bottom portion being flush; and where the ring encircles the bottom portion.

2. The retractable cord system of claim 1, where the strap exists as a spool inside the bottom portion, where the strap exits the bottom portion through an opening, and where the strap is pulled out from the bottom portion into an expanded state.

3. The retractable cord system of claim 2, where the at least one keyring attaches to an end of the strap that exits the bottom portion.

4. The retractable cord system of claim 3, where the spool encircles the retractor.

5. The retractable cord system of claim 4, where the at least one keyring attaches to the ring of other retractable cord systems and is movable around the ring.

6. The retractable cord system of claim 5, where the strap forms angles when attached to other retractable cord systems.

7. The retractable cord system of claim 6, where the plurality of spikes protrudes from the bottom portion and into the playing surface.

8. The retractable cord system of claim 7, where deployment of the button moves the ladder and compresses the spring, returning the strap through the opening into a collapsed state within the bottom portion.

9. The retractable cord system of claim 8, where the button is on an outward facing surface of the top portion and the spring and the ladder are on an inward facing surface of the top portion.

10. The retractable cord system of claim 5, where the at least one keyring has a magnet at its distal end.

11. A retractable cord system for grounding on a playing surface consisting of a top portion, a bottom portion, an opening, a strap, a button, a ladder, a retractor, a spring, a plurality of spikes, a ring, and at least one keyring, where the top portion and bottom portion are flush, the strap exists as a spool within the bottom portion, the spool encircles the retractor, the spring and ladder are on an inward facing surface of the top portion, the button is on an outward facing surface of the top portion, the strap exits from the opening, the at least one keyring is attached to an end of the strap that exits the opening, the at least one keyring attaches to the ring of other retractable cord systems via a magnet at the at least one keyring's distal end and is movable around the ring, the plurality of spikes protrudes from the bottom portion and into the playing surface, the ladder is connected to the button and the ladder is connected to the spring, the ring encircles the bottom portion, the strap is pulled out from the opening into an expanded state, the strap forms angles when attached to other retractable cord systems, and where deployment of the button moves the ladder and compresses the spring to return the strap to a collapsed state within the bottom portion.

* * * * *